US009630810B1

(12) United States Patent
Kinser, Jr.

(10) Patent No.: US 9,630,810 B1
(45) Date of Patent: Apr. 25, 2017

(54) HOOK FOR A HOIST SYSTEM

(71) Applicant: VOLVO TRUCK CORPORATION, Göteborg (SE)

(72) Inventor: Paul Edward Kinser, Jr., Bluefield, WV (US)

(73) Assignee: VOLVO TRUCK CORPORATION, Gothenburg (SE)

( * ) Notice: Subject to any disclaimer, the term of this patent is extended or adjusted under 35 U.S.C. 154(b) by 0 days.

(21) Appl. No.: 15/060,708

(22) Filed: Mar. 4, 2016

(51) Int. Cl.
*B66C 1/36* (2006.01)

(52) U.S. Cl.
CPC ..... *B66C 1/36* (2013.01)

(58) Field of Classification Search
CPC ..... B66C 1/36; F16B 45/04
USPC ..... 294/82.23
See application file for complete search history.

(56) References Cited

U.S. PATENT DOCUMENTS 1,729,188 A * 9/1929 Schillinger ..... E21B 19/04 24/600.8
1,740,782 A * 12/1929 Ratigan ..... E21B 19/04 24/600.7
2,084,722 A * 6/1937 Del Baker ..... B66C 1/36 102/313
2,091,093 A * 8/1937 Buccicone ..... B66C 1/36 24/600.7
5,593,113 A * 1/1997 Cox ..... B64D 1/08 177/245
8,888,156 B2 * 11/2014 David ..... B66C 1/42 294/197
2006/0175851 A1 * 8/2006 Snyder ..... B66C 1/34 294/82.33

FOREIGN PATENT DOCUMENTS

| | | | |
|---|---|---|---|
| FR | 2754805 | A1 | 4/1998 |
| JP | 2007044166 | A | 2/2007 |
| JP | 2010046325 | A | 3/2010 |
| KR | 20030035526 | A | 5/2003 |

* cited by examiner

*Primary Examiner* — Dean Kramer
(74) *Attorney, Agent, or Firm* — Martin Farrell; Michael Pruden

(57) ABSTRACT

A hook for a hoist system includes a hook having a hook body and a loading portion, a latch movably connected to the hook having an open position wherein the hook is open and a closed position wherein the hook is closed, a first sensor operable to sense a position of the latch and to generate a signal responsive to the latch being in the closed position, a lock movably connected to the hook and having a locked position wherein movement of the latch from the closed position is obstructed by the lock and an unlocked position wherein movement of the latch from the closed position is unobstructed by the lock, and, a second sensor operable to sense a position of the lock and to generate a signal responsive to the lock being in the locked position.

11 Claims, 4 Drawing Sheets

HOOK FOR A HOIST SYSTEM

FIELD OF THE INVENTION

The invention relates to a hoist system and more particularly to a hoist system with a hook including a latch and lock mechanism and sensors for determining the status of the latch and lock mechanism.

BACKGROUND AND SUMMARY

The art shows lift hooks for hoist systems with latch mechanisms to prevent a load on the hook from separating from the hook. The invention provides an improved hook system for a hoist.

The invention provides a hoist system with a hook having a latch to close the hook and a lock to secure the latch in the closed position. The invention further provides sensors to determine the status of the latch and the lock and a processor that receives status signals from the sensors and generates a signal for the hoist controller to allow a lift mechanism to lift a load if the latch and the lock are both engaged and to prohibit the lift mechanism from lifting the load if either the latch or the lock is not engaged.

A hook for a hoist system according to the invention includes a hook having a hook body and a loading portion, a latch movably connected to the hook having an open position wherein the hook is open and a closed position wherein the hook is closed, a first sensor operable to sense a position of the latch and to generate a signal responsive to the latch being in the closed position, a lock movably connected to the hook and having a locked position wherein movement of the latch from the closed position is obstructed by the lock and an unlocked position wherein movement of the latch from the closed position is unobstructed by the lock and, a second sensor operable to sense a position of the lock and to generate a signal responsive to the lock being in the locked position.

BRIEF DESCRIPTION OF THE DRAWINGS

The invention will be better understood by reference to the following detailed description read in conjunction with the appended drawings, in which.

DETAILED DESCRIPTION OF THE INVENTION

Figure 1:
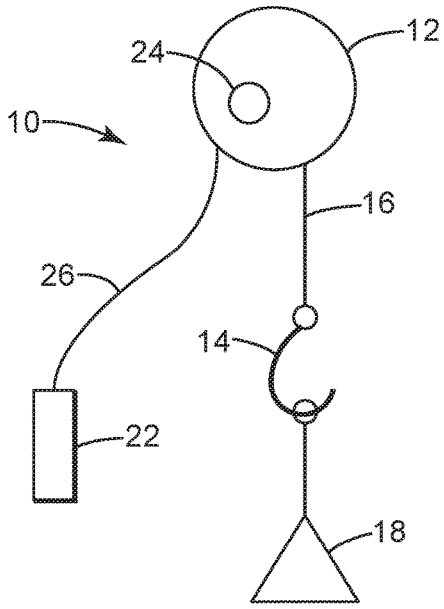
FIG. 1 is a schematic of a hoist system according to the invention.

An exemplary embodiment of a hoist system 10 is illustrated schematically in FIG. 1. The hoist system 10 includes a lift mechanism 12 arranged to raise or lower a hook 14 from which a load 18 may be removably suspended. The hook 14 may be attached to the lift mechanism by a line 16 in the form of a chain, cable, rope or other type of elongated flexible element. The lift mechanism 12 may include a spool (not shown) on which the line is wound and which may be powered by a motor (not shown), for example, an electric, hydraulic, or internal combustion motor. The hoist system 10 may further include a controller 22 operable to send instructions to a processor 24, which in turn, may control lift mechanism 12 for raising or lowering hook 14. Although the processor 24 is shown in FIG. 1 as being incorporated in the lift mechanism 12, the processor 24 may be disposed separately from lift mechanism 12. The controller 22 in FIG. 1 is shown connected to the processor 24 by a wire 26; however, alternatively, the controller 22 may be connected with processor 24 wirelessly, for example, using RF transceivers (not shown).

Figure 2A:
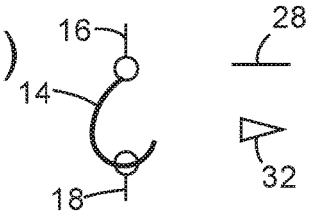
FIGS. 2(*a*) to 2(*d*) illustrate schematically an exemplary embodiment of a hook with a latch, a lock, and a pair of sensors showing how the elements cooperate to secure a load on the hook.
Figure 2B:
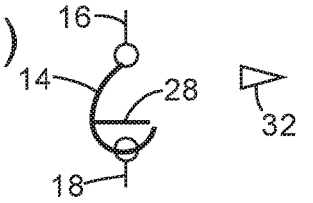
Figure 2C:
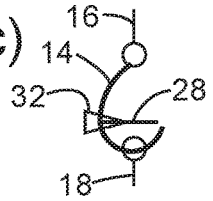

As further shown in the schematic illustration of FIG. 2*a*, the hook 14 may include a latch 28 and a lock 32. As may be appreciated in FIGS. 2*a* and 2*b*, the latch 28, represented schematically, is operable to open the hook 14 to allow a load to be attached and to close the hook to prevent an attached load from being removed from the hook. Further, and as shown in FIGS. 2*b* and 2*c*, lock 32, represented schematically, is operable to secure the latch 28 in the closed position. Additional exemplary embodiments including both a latch 28 and a lock 32 will be described further below.

Figure 2D:
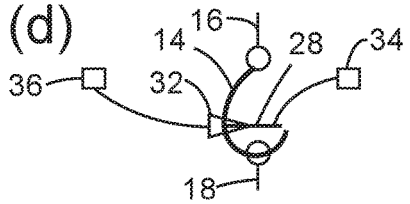
Figure 3:
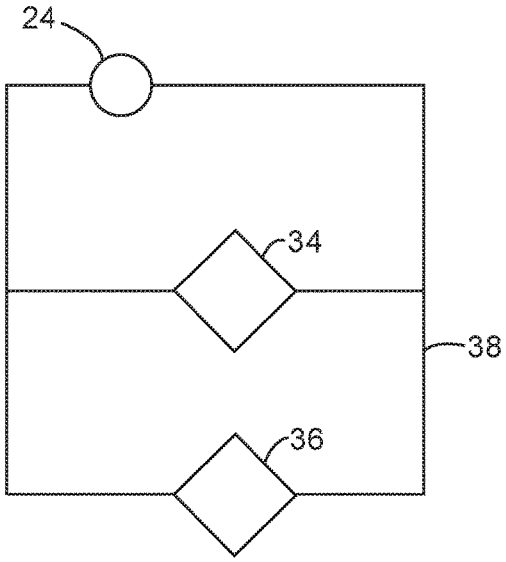
FIG. 3 is a schematic of an exemplary embodiment of a portion of an interlock circuit according to the invention.

As shown in FIG. 2*d*, the hook 14 may also include a first sensor 34 operable to determine whether the latch 28 is in a position closing the hook 14 and a second sensor 36 operable to determine whether the lock 32 is in a position securing the latch 28 in the closed position. As shown in FIG. 3, first sensor 34 and second sensor 36 may be included in an interlock circuit 38 with processor 24 (FIG. 1). Processor 24 may be operable to automatically inhibit operation of lifting mechanism 12 unless the hook 14 is closed according to the determination of the first sensor 34 and latch 28 is secured by the lock 32 according to the determination of the second sensor 36. For example, if the hoist system 10 includes an electric motor (not shown) for powering lift mechanism 12, the processor 24 may be configured to prevent power from being delivered to the electric motor if the sensor 34 fails to determine that the hook is closed by the latch 28 or if the sensor 36 fails to determine that the latch 28 is secured by the lock 32.

Figure 4:
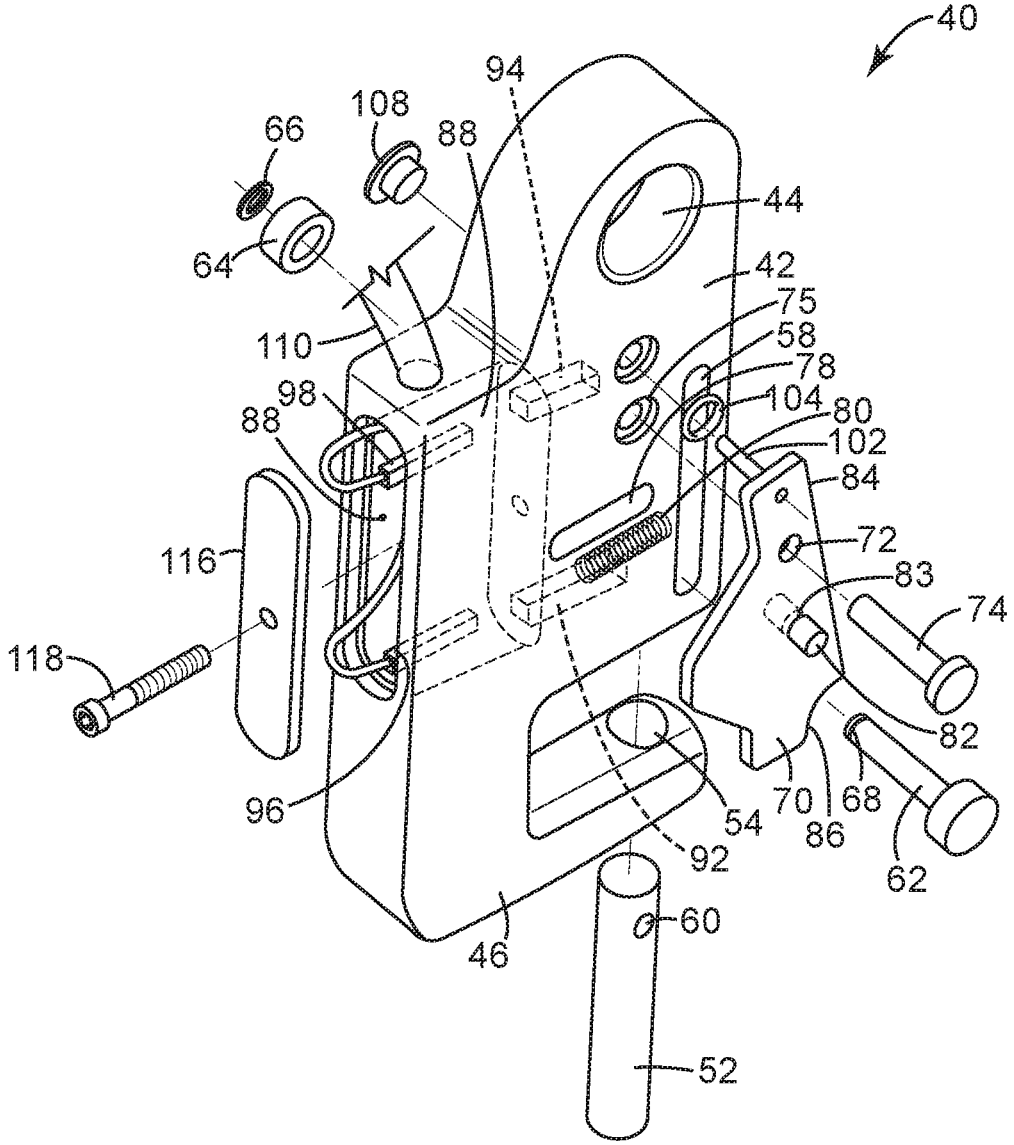
FIG. 4 is an exploded, perspective view of an exemplary embodiment of another hook according to the invention.
Figure 5:
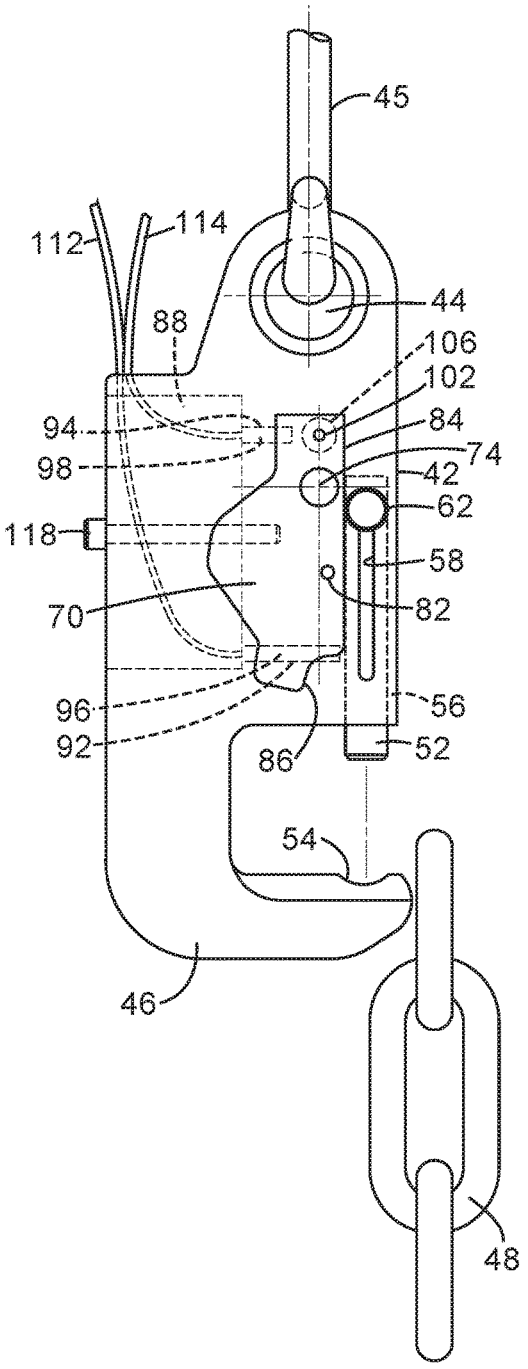
FIGS. 5-6 show illustrations of the embodiment of FIG. 4 in an open and a closed position.
Figure 6:
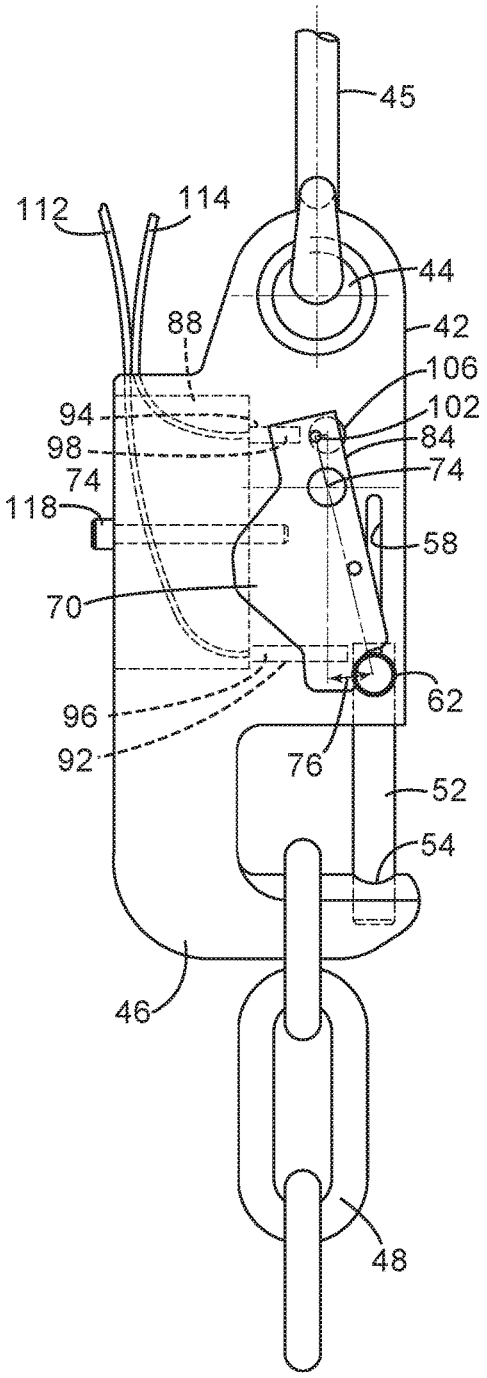

FIGS. 4-6 show a hook 40 according to an exemplary embodiment. The hook 40 may include a body portion 42 having a hole 44 for connection with a line (for example, line 16 in FIG. 1) in the form of a cable 45 (FIGS. 5 and 6). The hook 40 includes a loading portion 46 for accepting and supporting a load. For example, a load may be removably connected to the hook 40 by hanging a chain 48 on the loading portion 46.

To secure a load on the hook 40, a latch in the form of a plunger rod 52 is operable to close a gap between the hook body portion 42 and the loading portion 46. The plunger rod 52 is slidably disposed in a bore 56 in the body portion 42 for movement between an open position with the rod 52 retracted in the body portion (FIG. 5) and a closed position with the rod extended from the body portion to engagement with a receiver 54 formed in the loading portion 46 (FIG. 6). During assembly, and as shown in FIG. 4, plunger rod 52 may be inserted through the receiver 54 into the bore 56 (FIG. 5) in body portion 42.

A retaining pin 62 is attached to and extends from the plunger rod 52 for manipulation of the rod. The retaining pin 62 is carried in a slot 58 formed on the body portion 42 and open to the bore 56. A second slot, not visible in the drawings, also open to the bore, is formed on the opposite side of the body portion 42. The retaining pin 62 is inserted through the slot 58, through a hole 60 (FIG. 4) in the plunger rod 52, and through the opposite slot into a retaining collar 64. A snap ring 66 may be engaged with a corresponding groove 68 in the pin 62. The pin 62 may move in the slot 58 and the slot on the opposite side to move the plunger rod 52 between the hook 40 open position (FIG. 5) and the hook closed position (FIG. 6).

As shown in FIG. 4, the hook 40 further includes a lock in the form of a cam plate 70. The cam plate 70 selectively engages the pin 62 to prevent movement of the pin. The cam plate 70 includes a first cam surface 84 that contacts the pin 62 in the unlocked position and allows relative movement of the pin on the first cam surface 84. The cam plate 70 includes a second cam surface 86 formed as a notch that catches the pin to prevent movement. The cam plate 70 is mounted to the body portion 42 for pivotal movement between an unlocked position shown in FIG. 5 in which the pin 62 contacts the first cam surface 84 and is able to move relative to the cam plate and a locked position shown in FIG. 6 in which the pin contacts the second cam surface 86, which blocks movement of the pin.

The cam plate 70 is mounted to the hook body portion 42 by a pivot pin 74 inserted through a hole 72 in cam plate 70 and engaged with a hole 75 in body portion 42 as shown in FIG. 4. The cam plate 70 is biased toward the locked position (FIG. 6) by a spring 80 carried in the body portion 42 that acts on a post 82 mounted on the cam plate. The spring 80 is disposed in a pocket 78 formed in the body portion 42. The post 82 is mounted in a hole 83 in the cam plate 70 and extends into engagement with the spring 80 in the spring pocket 78 such that the pivoting movement of cam plate 70 is biased towards pin 62. The spring pocket 78 and the post 82 may cooperate to limit the pivot range of cam plate 70 to the arc segment 76 shown in FIG. 6.

During operation of the hook 40, the loading portion 46 may be engaged with a chain 48 to secure a load 18 (FIG. 1) to hook 40. Note that during this operation, plunger rod 52 may be advantageously maintained in the open position, i.e., substantially within bore 56, by friction between the spring-biased contact of cam surface 84 with retaining pin 62. To move rod 52 from the open position, pin 62 may be pushed toward loading portion 46. Note that when pin 62 approaches the end of travel within slot 58, the distal end of rod 52 is disposed within receiver 54 and the hook 40 is thereby closed. As may be appreciated in FIG. 6, in this extended or closed position, the plunger rod 52 contains the load within hook 40.

When the plunger rod 52 approaches the closed position, the retaining pin 62 travels past the end of cam surface 84 allowing the cam plate 70 to further pivot under the biasing force of spring 80 such that a lock surface 86 of the cam plate 70 engages and captures the retaining pin 62. The lock surface 86 prevents movement of the retaining pin 62, thereby locking the plunger rod 52 in the extended, locked position and maintaining hook 40 in a closed configuration.

Note that, advantageously, the cam plate 70 is prevented from pivoting to the locked position by the pin 62 when the rod 52 is in the open or retracted position, as shown in FIG. 5.

To open the hook 40, for example, to unload or adjust chain 48 at loading portion 46, the cam plate 70 may be pivoted against the force of the spring 80, for example, by applying a force to post 82 to pivot cam plate away from pin 62. Pin 62 is thereby unobstructed by the lock surface 84 of cam plate 70 and the pin 62 and the rod 52 may therefore move toward the open position. With the rod 52 in the open position, the loading portion 46 of the hook 40 may be separated from the chain 48.

As further shown in FIGS. 4 to 6, the body portion 42 of the hook 40 may be provided with first and second proximity sensors 96 and 98, each received in a respective bore, 92 and 94, formed in the body portion 42. The sensor bores 92, 94, may extend from a cavity 88. First proximity sensor 96 may generate a signal indicating a presence of the pin 62 and/or plunger rod 52 at a particular position, which signal is provided to the processor 24 (FIG. 1). The second proximity sensor 98 may generate a signal indicating a presence of the cam plate 70 at a particular position or orientation, which is provided to the processor 24. As will be described further below, the processor 24 may be configured to inhibit operation of lifting mechanism 12 unless the rod 52 is in the closed position according to the first sensor 96 and the cam plate 70 is in the locked position according to the second sensor 98.

As further shown in FIG. 4, the cam plate 70 may include a post 102 extending into a bore 106 in body portion 42. The post 102 may function as a flag detectable by the second proximity sensor 98 for sensing a position of cam plate 70. To protect bore 106 and post 102, an O-ring 104 may be disposed between cam plate 70 and a first end of bore 106 and a plug 108 may be provided at a second end of bore 106.

The processor 24 (FIG. 1) may be connected to the first proximity sensor 96 and the second proximity sensor 98 by lines 112 and 114, respectively, extending through a conduit 110 and into the cavity 88 which is open to bores 92 and 94 as shown in FIGS. 4 to 6. The cavity 88 may be provided with a cover 116 connected to body portion 42 by a threaded bolt 118. Although the proximity sensors 96 are 98 are shown as being provided with a wired connection to processor 24, the cavity 88 may be sized to house transmitters (not shown) for a wireless connection between the processor 24 and the proximity sensors 96 and 98.

During operation, processor 24 may function to allow or inhibit operation of the lifting mechanism 12 based on a signal or lack of signal from each of the proximity sensors 96 and 98. For example, the first proximity sensor 96 may form a switch which is normally closed and which opens when the rod 52 and the pin 62 assembly are in the open position. The second proximity sensor 98 may form a normally open switch which closes when the post 102 moves into proximity of the sensor 98. The processor 24 may determine that the hook 40 is open if the first proximity sensor 96 fails to detect the proximity of pin 62. Similarly, the processor 24 may determine that the cam plate 70 is in the unlocked position if the second proximity sensor 98 fails to detect the proximity of flag 102. In either condition, the processor 24 may determine that an unsecured condition exists at the hook 40 and operation of the lifting mechanism 12 may be inhibited by the processor 24, for example, by preventing power delivery to the lifting mechanism 12 as previously described.

Note that even if the cam plate 70 were to fail in the unlocked position, and further, even if simultaneously, the sensor 98 were to falsely indicate that the cam plate 70 is in the locked position, the rod 52 may nonetheless descend, for example, under the force of gravity into engagement with receiver 54, thereby closing the hook 40 and securing the load 18. In other words, both the cam plate 70 and the sensor 94 may fail without preventing closure of the hook 40. Thus, hoist system 10 may advantageously provide both electrical and mechanical redundant solutions for enhancing safety.

Figure 7:
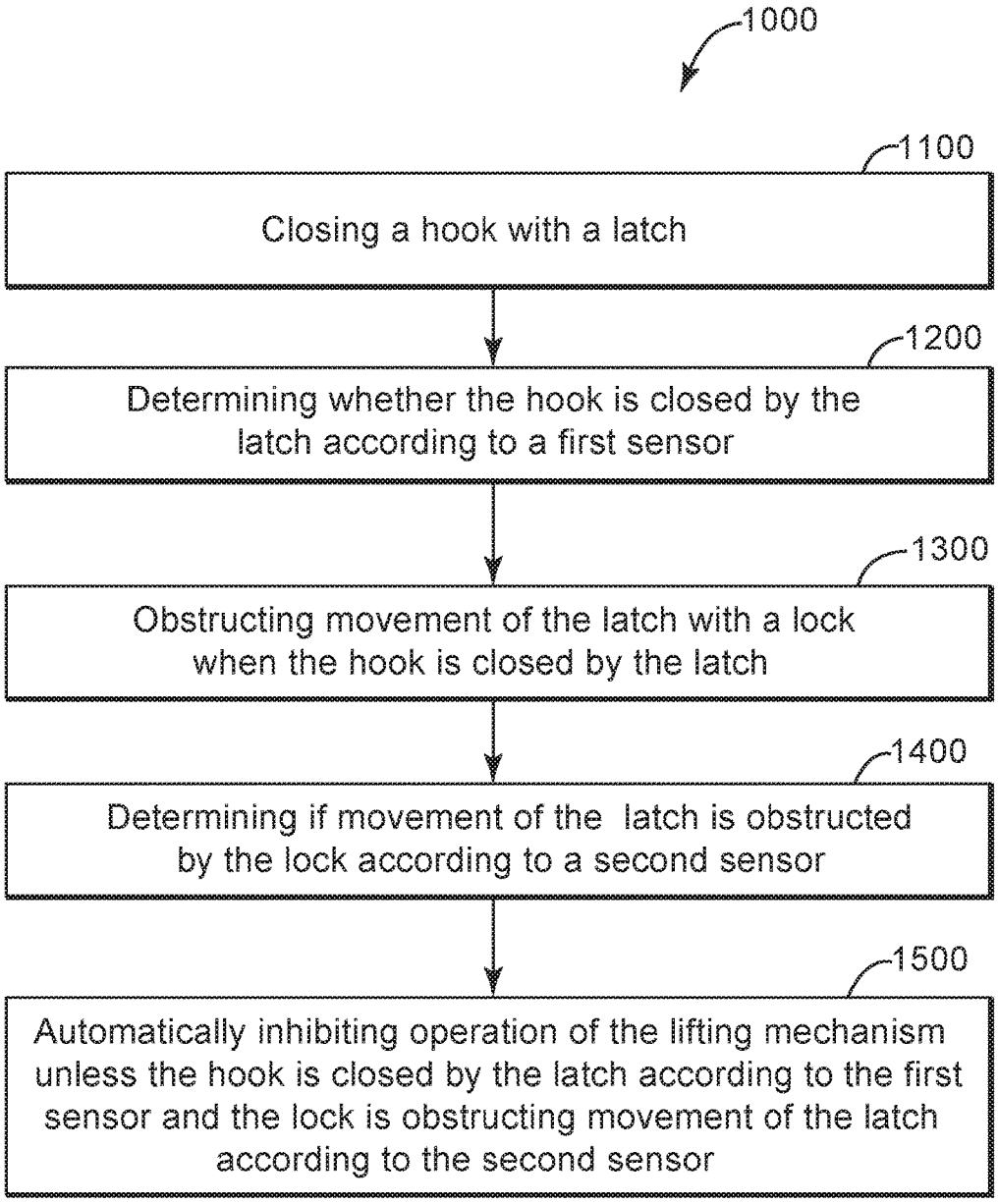
FIG. 7 shows a method according to the invention.

FIG. 7 shows a method 1000 according to an exemplary embodiment. Step 1100 includes closing a hook with a latch. Step 1200 includes determining whether the hook is closed by the latch according to a first sensor. Step 1300 includes obstructing movement of the latch with a lock when the hook is closed by the latch. Step 1400 includes determining if movement of the latch is obstructed by the lock according to a second sensor. And, step 1500 includes automatically inhibiting operation of the lifting mechanism unless the hook is closed by the latch according to the first sensor and the lock is obstructing movement of the latch according to the second sensor.

The invention has been described in terms of preferred principles, embodiments, and componentry; however, those skilled in the art will understand that some substitutions may be made without departing from the scope of the invention as defined by the appended claims.

What is claimed is:

1. A hook for a hoist system, comprising:

a hook having a hook body portion and a loading portion;

a latch movably connected to the hook having an open position wherein the hook is open and a closed position wherein the hook is closed;

a first sensor operable to sense a position of the latch and to generate a signal responsive to the latch being in the closed position;

a lock movably connected to the hook and having a locked position wherein movement of the latch from the closed position is obstructed by the lock and an unlocked position wherein movement of the latch from the closed position is unobstructed by the lock, wherein the lock is a cam plate pivotally connected to the body portion for pivotal movement between the locked and unlocked positions, the cam plate having a cam surface for sliding contact with a retaining pin carried in a slot in the body portion when the cam plate is in the unlocked position, the cam plate having a lock surface for engaging the retaining pin to obstruct movement of the latch when the cam plate is in the locked position; and, a second sensor operable to sense a position of the lock and to generate a signal responsive to the lock being the locked position.

2. The hook of claim 1, wherein the first and second sensors are disposed within the body portion of the hook.

3. The hook of claim 2, wherein at least one of the first and second sensors is a proximity sensor.

4. The hook of claim 1, wherein the latch is a plunger rod received in a bore of the body portion of the hook and being retractable into the bore to open the hook and extendable from the bore to the loading portion to close the hook.

5. The hook of claim 4, wherein the body portion includes a slot open to the bore and the plunger rod includes a retaining pin extending therefrom, the retaining pin carried in the slot and being movable in the slot to extend and retract the plunger rod.

6. The hook of claim 5, wherein the loading portion includes a receiver for receiving an end of the plunger rod when the plunger rod is extended to close the hook.

7. The hook of claim 1, wherein the cam plate is biased towards the locked position.

8. The hook of claim 7, wherein the cam plate includes a post extending therefrom and engaged with a spring carried in a pocket in the body portion, the spring acting on the post to bias the cam plate towards the locked position.

9. The hook of claim 1, wherein movement of the cam plate from the unlocked position toward the locked position is obstructed by the latch when the hook is open.

10. A hook for a hoist system, comprising:

a hook having a hook body and a loading portion;

a latch movably connected to the hook having an open position wherein the hook is open and a closed position wherein the hook is closed, wherein the latch is a plunger rod received in a bore of a body portion of the hook and being retractable into the bore to open the hook and extendable from the bore to the loading portion to close the hook;

wherein the body portion includes a slot open to the bore and the plunger rod includes a retaining pin extending therefrom, the retaining pin carried in the slot and being movable in the slot to extend and retract the plunger rod;

a first sensor operable to sense a position of the latch and to generate a signal responsive to the latch being in the closed position;

a lock movably connected to the hook and having a locked position wherein movement of the latch from the closed position is obstructed by the lock and an unlocked position wherein movement of the latch from the closed position is unobstructed by the lock; and, a second sensor operable to sense a position of the lock and to generate a signal responsive to the lock being the locked position.

11. A hoist system comprising:

a lifting mechanism adapted to raise and lower a load;

a hook operably connected to the lifting mechanism to support a load on the lifting mechanism, the hook having a hook body and a loading portion, the hook further comprising a latch movably connected to the hook having an open position wherein the hook is open and a closed position wherein the hook is closed, wherein the latch is a plunger rod received in a bore of a body portion of the hook and being retractable into the bore to open the hook and extendable from the bore to the loading portion to close the hook, wherein the body portion includes a slot open to the bore and the plunger rod includes a retaining pin extending therefrom, the retaining pin carried in the slot and being movable in the slot to extend and retract the plunger rod;

a first sensor operable to sense a position of the latch and to generate a signal responsive to the latch being in the closed position;

a lock movably connected to the hook and having a locked position wherein movement of the latch from the closed position is obstructed by the lock and an unlocked position wherein movement of the latch from the closed position is unobstructed by the lock;

a second sensor operable to sense a position of the lock and to generate a signal responsive to the lock being the locked position; and, a processor configured to receive the signals from the first sensor and the second sensor and operable to automatically inhibit operation of the lifting mechanism unless the latch is in the closed position according to the first sensor and the lock is in the locked position according to the second sensor.

* * * * *